United States Patent [19]

Larronde

[11] Patent Number: 4,630,244

[45] Date of Patent: Dec. 16, 1986

[54] ROTARY ACTING SHEAR VALVE FOR DRILLING FLUID TELEMETRY SYSTEMS

[75] Inventor: Michael L. Larronde, Houston, Tex.

[73] Assignee: NL Industries, Inc., New York, N.Y.

[21] Appl. No.: 595,324

[22] Filed: Mar. 30, 1984

[51] Int. Cl.[4] ..... H04H 9/00; E21B 34/10

[52] U.S. Cl. ..... 367/84; 166/374

[58] Field of Search ..... 367/82, 83, 84, 85; 166/373, 374; 175/48; 340/853, 861; 137/625.21

[56] References Cited

U.S. PATENT DOCUMENTS

| | | | |
|---|---|---|---|
| Re. 30,055 | 7/1979 | Claycomb | 367/84 |
| 3,739,331 | 6/1973 | Godbey et al. | 367/142 |
| 3,820,063 | 6/1974 | Sexton et al. | 367/84 |
| 3,867,714 | 2/1975 | Patton | 367/85 |
| 3,964,556 | 6/1976 | Gearhart et al. | 367/83 X |
| 4,033,429 | 7/1977 | Farr | 367/84 X |
| 4,040,003 | 8/1977 | Beynet et al. | 367/84 |
| 4,351,037 | 9/1982 | Scherbatskoy | 367/85 |
| 4,499,563 | 2/1985 | Jurgens . | |
| 4,531,579 | 7/1985 | Larronde et al. | 175/48 |

*Primary Examiner*—Charles T. Jordan
*Assistant Examiner*—Brian S. Steinberger
*Attorney, Agent, or Firm*—Browning, Bushman, Zamecki & Anderson

[57] ABSTRACT

A mud pulse telemetry system for imparting data pulses to drilling fluids circulating in a drill string including an improved valve arrangment for modulating the pressure of the circulating drilling fluid is disclosed. A rotary acting shear-type valve is arranged in a through conduit configuration so that the seat face of the valve is covered when the valve is in an open position, thus preventing impingement of abrasive fluid particles on the valve seat face during the open flow position of the valve. The rotatable gate is positively driven through an arc in opposite directions by rotary solenoids so that a gate aperture is moved into and out of axial alignment with the opening in the valve seat to generate the pressure pulse. The rotary solenoid valve also permits a tailoring of the force curve of the solenoid for maximum power in actuation of larger flow orifices. The larger flow orifice permits generation of pressure pulses of increased amplitude.

11 Claims, 8 Drawing Figures

ROTARY ACTING SHEAR VALVE FOR DRILLING FLUID TELEMETRY SYSTEMS

BACKGROUND OF THE INVENTION

1. Field of the Invention

The present invention relates to drilling fluid telemetry systems and, more particularly, to a telemetry system incorporating a rotary valve for modulating the pressure of a drilling fluid circulating in a drill string within a well bore.

2. History of the Prior Art

Drilling fluid telemetry systems, generally referred to as mud pulse systems, are particularly adapted for telemetry of information from the bottom of a borehole to the surface of the earth during oil well drilling operations. The information telemetered often includes, but is not limited to, parameters of pressure, temperature, salinity, direction and deviation of the well bore and bit conditions. Other parameters include logging data such as resistivity of the various layers, sonic density, porosity, induction, self potential and pressure gradients. This information is critical to efficiency in the drilling operation.

One example of a prior mud pulse system of the aforesaid variety is illustrated in U.S. Pat. No. 3,964,556. The principles set forth therein require that circulation of drilling fluids be ceased in order to operate the system. Other systems have used a controlled restriction placed in the circulating mud stream and are commonly referred to as positive pulse systems. With mud volume sometimes surpassing 600 gpm and pump pressures exceeding 3000 psi, the restriction of this large, high pressure flow requires very powerful downhole apparatus and energy sources. Further, the systems must require the movement of valve parts under extremely high pressure conditions. This condition results in a myriad of problems relating to the durability of the valve parts subjected to the high pressure, abrasive, fluid flow conditions.

Another example of a prior mud pulse system is illustrated in U.S. Pat. No. 4,351,037. This technology includes a downhole valve for venting a portion of the circulating drilling fluids from the interior of the drill string to the annular space between the pipe string and the borehole wall. Drilling fluids are circulated down the inside of the drill string, out through the drill bit and up the annular space to the surface. This circulation pattern develops a pressure differential of about 1000 to 3000 psi across the drill bit. In like manner, a substantial pressure differential exists across the wall of the drill string disposed above the drill bit. By momentarily venting a portion of the fluid flow out a lateral port above the bit in the drill string, a instantaneous pressure drop is produced and is detectable at the surface to provide an indication of the downhole venting. A downhole instrument or detector is arranged to generate a signal or mechanical action upon the occurrence of a downhole detected event to produce the above-described venting. The downhole valve which is disclosed is defined in part by a valve seat having an inlet and outlet, and a valve stem movable to and away from the inlet end of the valve seat and in a linear path with the drill string.

A major problem associated with negative pressure pulse systems is the wear and replacement of valve parts, particularly as the data rate is expanded. It is highly desirable to operate such a system as long as possible since replacement of system components typically requires the time consuming and expensive removal of the valve system from its downhole location and from the drill string at the well head for replacement of the worn parts.

Prior art systems incorporating poppet valves exhibit deletrious wear due to the circuitous flow path of fluid through the valve. The seat of the poppet is worn rapidly by high rates of abrasive fluid flow when the valve is in the open position. Further the design of the poppet is such that a pulse is created only when the valve is open and, therefore fluid flows around and also abrades the valve stem. In addition, it is desirable to have a fast acting opening and closing movement of the valve parts in order to create a sharp pressure pulse for adequate detection at the surface. Rapid closing of the poppet valve generates a high valve head impact force on the valve seat. This force rapidly wears the valve parts, particularly when abrasive particles are present in the fluid flow through the valve. Such particles become impacted in the valve parts and deteriorate the sealing surfaces of the valve. The repeated impact forces may also break portions of the valve parts because erosion resistant materials are generally brittle and not impact resistant.

In view of the disadvantages of poppet valve designs, other valve systems have been improved. Another negative pulse system of prior art design employs a rotary acting valve which utilizes a mass of rotational valve parts. A drive motor and gear system is incorporated to operate the rotational valve head for registration of flow apertures. While effective in reducing abrasive wear the valve actuation through a motor and gear train is relatively slow which reduces pressure pulse definition.

The aforesaid examples illustrate some of the critical considerations that exist in the application of a rapidly acting valve to a high pressure fluid flow for generating a sharp pressure pulse. Other considerations in the use of these systems for borehole operations involve the extreme impact forces and vibrational energies existing in a moving drill string. The result is excessive wear, fatigue, and failure in operating parts of the system. The particular difficulties encountered in a drill string environment, including the requirement for a long-lasting system to prevent premature malfunction and replacement of parts, require a simple and rugged valve system One advance in mud pulse telemetry systems is shown in co-pending application No. 460,461, filed Jan. 24, 1983 and assigned to the assignee of the present invention. A linear shear valve is disclosed therein which overcomes many of the disadvantages of the prior art and is an excellent overall system for most mud pulse telemetry applications. However, for certain applications requiring higher pulse amplitudes and thus greater valve flow rates the linear acting shear valve exhibits certain limitations. For example, the maximum fluid flow rate and amplitude possible with a linear acting shear valve is limited by the size of the valve orifice which can be opened and closed within given power parameters. The force available for operating the valve gate is limited by the dimensions of the linear solenoid which can be housed within a borehole sub. Because the shear valve actuation is a marked improvement over prior art designs, it would be an advantage to provide the advantages thereof with the capacity of greater valve flow rate and higher pulse amplitude.

The methods and apparatus of the present invention overcome the foregoing disadvantages of the prior art by providing a new and improved mud pulse telemetry system utilizing an improved, rotary acting shear valve. The advantages of shear valve actuation are thus provided with a rotary solenoid system controlling a rotary valve gate and seat having a greater cross sectional flow configuration. The rotary solenoid valve also permits a tailoring of the force curve of the solenoid for maximum force over the required distance of movement for actuation of a larger flow valve.

SUMMARY OF THE INVENTION

The present invention contemplates a drilling fluid telemetry system utilizing a rotary acting shear valve system for modulating the pressure of the drilling fluid circulating in a drill string in a well bore. More particularly, one aspect of the invention includes a rotary acting shear valve comprising a housing disposed within the drill string, the housing having a flow passage formed therethrough, and a shear valve gate disposed across the passage for selective control of the flow of drilling fluid therethrough. One end of the flow passage is vented outside of the drill string and means are provided for selectively rotating the valve gate to impart pressure pulses within the drill string in response to opening and closing the flow passage.

Another aspect of the invention includes the operation of the valve gate by a solenoid having an actuating shaft rotationally connected to the valve gate for positive driving of the valve gate into open and closed positions in a minimum period of time. A valve seat is also provided in a mating configuration relative to the valve gate and constantly urged into contact therewith by a biasing force.

In another aspect, the invention includes an improved fluid flow valve for a borehole drilling fluid telemetry system of the type adapted for developing pressure changes in the drilling fluid during a drilling operation. Drilling fluid is circulated downwardly through the drill string and upwardly through the annulus formed between the drill string and the borehole. The improvements comprises a housing disposed within the drill string adapted for the flow of drilling fluid therearound and formed with a passage therethrough for select flow communication between the drill string and the borehole annulus. A shear valve is mounted within the housing across the passage and comprises a valve seat and rotation gate member having aligned openings formed therethrough. The gate opening is movable in an arc into and out of axial alignment with the valve seat opening. Valve actuation means are coupled to the gate for rotationally moving the gate opening thorough an arc relative to the valve seat to open the passage and impart a pressure pulse. Means are also provided for constantly urging the valve gate against the valve seat. The valve gate is a generally planar plate member having at least one gate opening therein of a sufficient size relative to the valve seat opening so that the gate opening edges are not exposed to abrasive mud flow when the valve is in an open position and the openings are in alignment.

In yet another aspect of the invention, the gate and seat opening geometries and valve actuating means are designed to minimize the opening and closing times thereof. In this manner the time that the seat is subjected to abrasive wear by the drilling fluid is minimized. These and other meritorious features and advantages of the present invention will be more fully appreciated from the following detailed description and claims.

BRIEF DESCRIPTION OF THE DRAWINGS

Other features and intended advantages of the invention will be more readily apparent by the references to the following detailed description in connection with the accompanying drawings wherein.

DESCRIPTION OF THE PREFERRED EMBODIMENT

Figure 1:
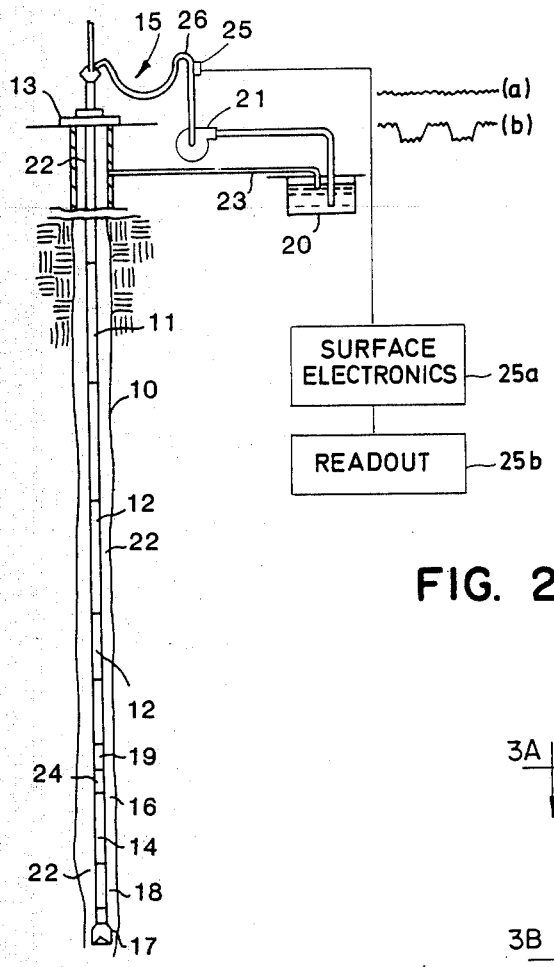
FIG. 1 is a schematic diagram of a borehole and drill string disposed therein illustrating the pressure pulse valve of the present invention and surface equipment for receiving telemetered data therefrom.

Referring first to FIG. 1 there is shown a borehole 10 with a drill string 11 disposed therein. The elements of the drill string 11 are schematically illustrated and include sections of drill pipe 12 suspended from a drilling platform 13 secured at the well head 15. A downhole assembly disposed at the end of drill string 11 includes a drill bit 17 above which is located sub 18. Sub 18 is constructed to house instruments for detecting borehole parameters. Such information is telemetered to the well head 15 by a telemetry shear valve system located in a sub 16 and which comprises the subject matter of the present invention.

Still referring to FIG. 1, the drill string 11 further includes a power supply sub 14 contiguous to the shear valve subassembly 16. An instrument sub 19 is secured above the valve sub 16 and houses associated electronics for encoding information indicative of detected data into a format which in turn drives valve sub-assembly 16 to impart data to the drilling fluid for telemetry to the surface. The drilling fluid or mud is circulated from a storage pit 20 or the like at the well head 15 by means of a pump 21 which moves the mud down the central axial opening in the drill string 11 to exit under high pressure through drill bit 17. As the mud passes through bit 17, it experiences a substantial drop in pressure because it moves into the larger space of the borehole annulus 22 surrounding the drill string. The mud then carries cuttings from the bottom of the borehole 10 to the well head 15 where they are removed and the mud is returned to pit 20 by conduit 23.

It may be seen in FIG. 1 that valve 16 includes a bypass passageway 24 which serves to connect the interior of the drill pipe fluid flow path with borehole annulus 22. A sufficient volume of mud can then be vented through valve 16 and passageway 24 to cause a pressure pulse modulation of the mud pressure which is detectable at the surface. A pressure transducer 25 is thus located in communication with a stand pipe 26 at the well head 15 for detecting such modulations of pump pressure in order to receive the data transmitted from downhole. The output of transducer 25 is decoded by surface electronics package 25(*a*) and the processed signals are then passed to readout equipment 25(*b*). A schematic format of an analog readout is illustrated in FIG. 1 adjacent electronics package 25(*a*). The top line (a) illustrates the pressure fluctuations that typify the normal oscillating pressure drop seen across the drill bit 17. Line (b) illustrates the discernable effect on surface pressure caused by effectively venting fluid through valve assembly 16 downhole. Effective valve operation required the capability of quick actuation, high flow rates and minimal deterioration from use in the hostile environment of the downhole region. The mud pulse telemetry system utilizing the rotary shear valve of the present invention in such a manner during a drilling operation will be described in more detail below.

Figure 2:
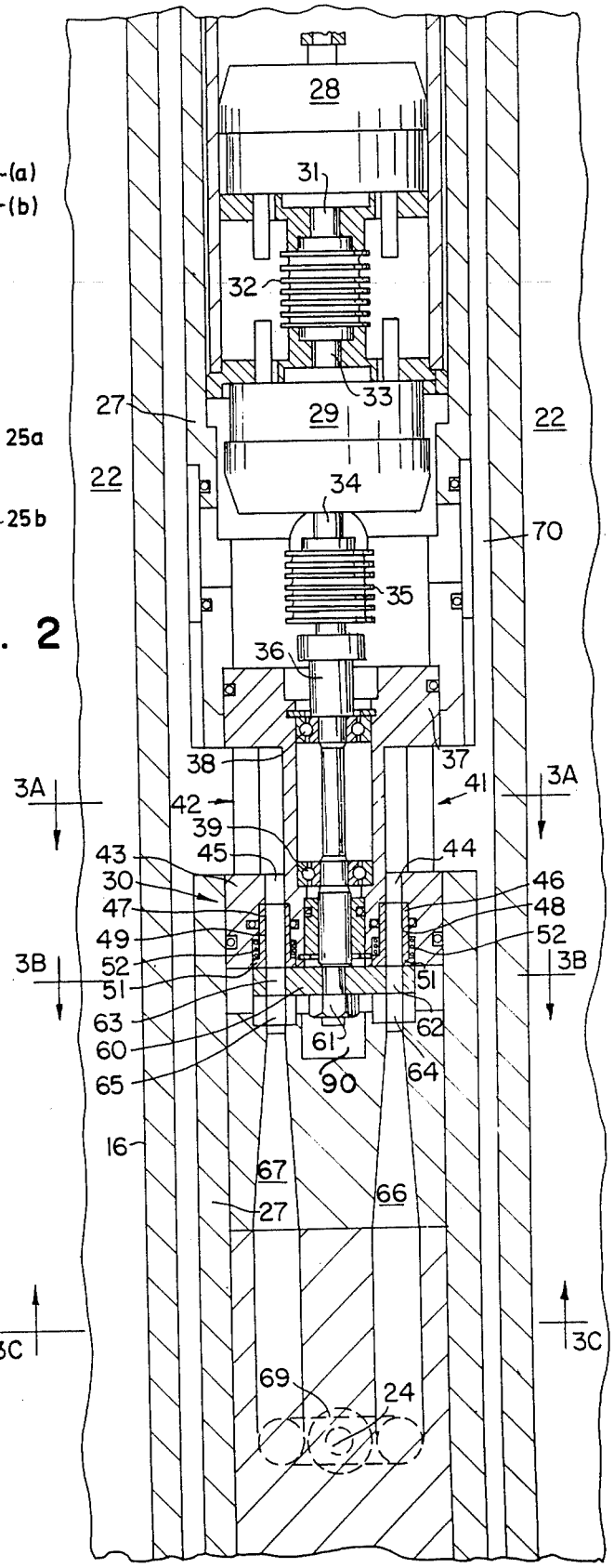
FIG. 2 is an enlarged cross-sectional, front elevational view of one embodiment of the modulating valve of the present invention.

Referring now to FIG. 2, a rotary valve assembly 30 forms the subject of the present invention and is shown in an enlarged side elevational, cross-sectional view. The valve assembly 30 is disposed in a generally cylindrical valve housing 27 which is sized for positioning within the bore of a drill collar or valve sub 16 having the dimensions of a drill collar. The valve sub 16 is then connected into drill string 11 to form part of the downhole mud flow path. Within the upper portion of housing 27 is mounted a pair of axially aligned and rotationally coupled solenoids 28 and 29. The upper solenoid 28 includes an output shaft 31 coupled to an output shaft 33 of lower solenoid 29. A flexible coupling 32 is utilized to link shafts 31 and 33 in rigid rotational interengagement while accommodating the axial shaft movement typical of solenoid actuation. A lower end 34 of the output shaft 33 of the lower solenoid 29 is then coupled through a flexible coupling 35 to an actuation shaft 36. The solenoids 28 and 29 are each constructed internally with cam and ramp mechanisms (not shown) which convert the linear actuation of their respective shafts 31 and 33 to rotational motion. The advantage of such an assembly is paramount in that the ramps and cams can be designed for high torque in the areas of shaft rotation necessary for overcoming maximum valve resistance to fluid flow. The ramp angle far into the stroke can thus be relatively steep to obtain a high rotational torque for low axial force. Such benefits are critical when handling high mass flow rates and high fluid pressures through the valve and are generally not available with linear actuation valve systems.

Still referrring to FIG. 2, the actuation shaft 36 is received through a valve mounting frame 37 which supports an upper bearing 38 and a lower bearing 39. The bearings journal the actuation shaft 36 for rotational movement. Beneath the mounting member 37, there is formed in the side walls of the housing 27 a pair of opposed crescent shaped recessses 41 and 42. The recesses 41 and 42 are in direct flow communication with the fluid passing down the central portion of the drill string 11, within the sub 16 and around the housing 27. The recesses 41 and 42 overly a bottom support member 43 having a pair of opposed axially extending openings 44 and 45 centrally located in each of the recesses 41 and 42. The flow passages 44 and 45 are respectively coaxial with a pair of cylindrical valve seats 46 and 47. The valve seats are positioned within shouldered recesses 48 and 49 formed in the lower portions of lower mounting member 43.

It may be seen in FIG. 2 that the cylindrical valve seats 46 and 47 each have radially extending flange members 51 which are received within the shouldered portions of the apertures 48 and 49. The cylindrical body of the valve seats 46 and 47 are received within a smaller diameter portion of the shouldered recess and sealed against fluid leakage by O-rings. The outer cylindrical surface of the valve seats 46 and 47 are positioned within the outer walls of the cylindrical shouldered portions 48 and 49 to form annular cavities 53 above and adjacent the radially extending flanges 51. Positioned within each of the annular cavities 53 is a helical spring 52 which surrounds the cylindrical body portion of the valve seat and spring biases the lower facing portion of the valve seats 46 and 47 into engagement with a rotationally actuated, valve gate 60. Gate 60 is elongate with flat upper and lower faces and a central aperture by which it is affixed to actuation shaft 36 by means of securing nut 61. Gate member 60 includes a pair of gate apertures 62 and 63 which, with one position of the gate, are in axial alignment with the open bores of the valve seats 46 and 47. Also in alignment with the open bores of the valve seats 46 and 47 and positioned beneath the gate member 60 is a pair of axially aligned exhaust ports 64 and 65. The bottom portions of the ports 64 and 65 are in fluid communication with a pair of exhaust passageways 66 and 67 which merge into a single exhaust port 69. The port 69 is in flow communication with vent port 24 which permits egress of fluid into the annulus 22.

Figure 3A:
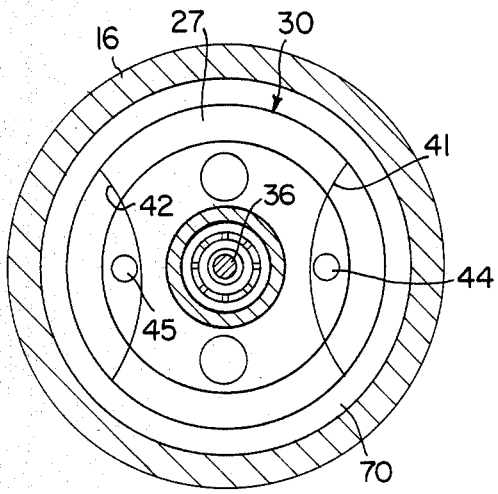
FIGS. 3A, 3B and 3C are top plan, cross-sectional view taken along lines 3A—3A, 3B—3B and 3C—3C respectively, of FIG. 2 illustrating the valve flow inlet ports, valve gate and valve flow exit ports of the pressure pulse valve.
Figure 3B:
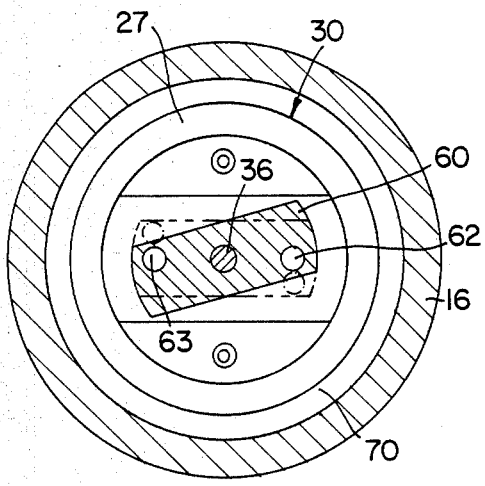
Figure 3C:
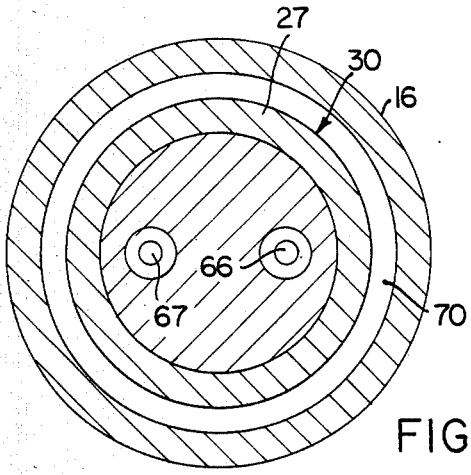

Referring now to FIG. 3 there is shown a series of top plan, cross-sectional views of sections of the valve assembly 30. FIG. 3A illustrates the position of recesses 41 and 42 and apertures 44 and 45 formed therein. FIG. 3B illustrates one angular position of valve gate 60 with its gating ports 62 and 63 in axial alignment with the valve seats 46 and 47 and exhaust port 64 and 65 respectively. In this configuration fluid flows from the region 70 around the housing 27 into the recesses 41 and 42 and through the ports 44 and 45. The fluid then flows through the valve seats 46 and 47, gate apertures 62 and 63, and exhaust ports 64 and 65. As shown in FIG. 3C the fluid then passes through exhaust passageways 66 and 67 to exit port 69 into the bore hole annulus 22.

Referring again to FIG. 3B, it may be seen that when the gating member 60 is rotated to the opposite rotational position, shown in phantom, the flat upper surface of the gate member 60 bears against the flanged ends 51 of the valve seats 46 and 47. The valve seats 46 and 47 are held in tight engagement with the gate 60 by means of the spring bias of the springs 48 and and the pressure of the fluid in annulus 70. The valve seats 46 and 47 are positioned beneath the upper end of shouldered recesses 48 and 49 whereby fluid pressure therein is exerted axially upon each valve seat to urge it against the gate 60. In this configuration the passageways 44 and 45 are sealed to prevent the passage of drilling fluids from the high pressure annulus 70 between the walls of the central bore of the drill string and the valve assembly housing 27 to the lower pressure annular space 22 between the outer walls of the drill string and the inner walls of the borehole 12.

Figure 4:
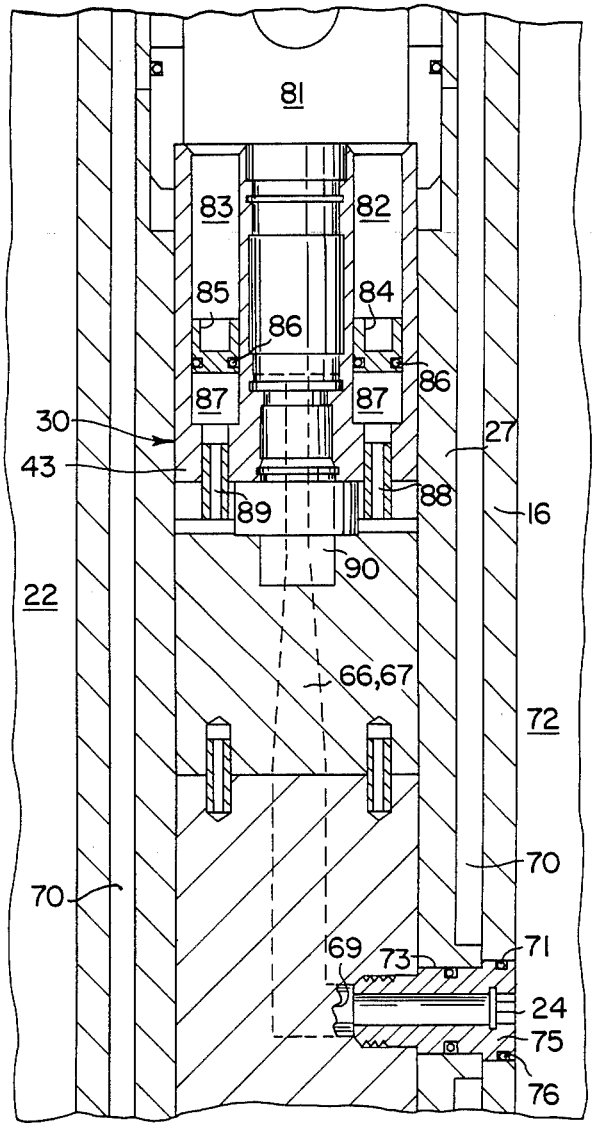
FIG. 4 is a side elevational, cross-sectional view of the modulating valve of FIG. 2 illustrating another aspect of the construction thereof.

Referring now to FIG. 4 it can be seen how the pair of exhaust passageways 66 and 67 merge in to the single exhaust port 69. The sidewall of the sub 16 includes a transverse aperture 71 in registration with a transverse opening 73 in the housing 27. The opening 73 receives a shouldered insert sleeve 75 threadedly secured in the opening and adapted for removal from the wall of the sub 16. An O-ring seals 76 are positioned between sleeve 75 and openings 71 and 73 to seal the interior bore 70 of the drill string from the annulus 22 between the drill string and the borehole wall.

Still referring to FIG. 4, there is shown an upper portion of the housing 27 formed with a borehole fluid access opening 81. The access opening 81 allows fluid within annulus 70 to communicate with a pair of opposed axial cylindrical bores 82 and 83 within which are positioned a pair of pressure equalization pistons 84 and 85, respectively. The pistons 84 and 85 are each assembled with O-ring seals 86 sealing them against the walls of the cylinders 82 and 83. The lower cavities 87 of the cylinders are filled with an oil in fluid communication with pressure conduits 88 and 89 formed in mounting member 43. The conduits 88 and 89 are vented beneath mounting member 43 into pressurizing cavity 90 formed adjacent the lower end of actuation shaft 36 (shown in FIG. 2) to which is affixed securing nut 61. Thus the pressure of the wellbore fluids from bore annulus 22 is transmitted through the pistons 84 and 85 and the oil filled cavities 87, 88 and 90 to equalize the pressure across the actuation shaft 36. This pressurization balance prevents binding of the bearings 38 and 39 from axial loads and minimizes the forces necessary to rotate the shaft 36 and actuate the gate member 60.

Thus, in operation, actuation of the solenoid 28 serves to bodily rotate the solenoid 29 its shaft 34 and the actuation shaft 36. This motion rotates the gate 60 into the closed position and blocks the flow of fluids through the valve 30. Fluid is then permitted to circulate in the normal fashion. Actuation of solenoid valve 29 rotates the actuation shaft 34 in the opposite direction. This motion rotates the actuation shaft 36 in the opposite direction and moves the gate 60, ports 62 and 63 into axial alignment with the openings of valve seats 46 and 47. This position allows high pressure fluid to pass from the annulus 70 in the drill collar through the exit ports 66 and 67 and exhaust ports 69 into the annulus 27 of the bore hole. This bypass flow produces a substantial and sharp pressure drop in the drilling fluid. The pressure drop is referred to as a negative pressure pulse when received at the wellhead 15.

Figure 5:
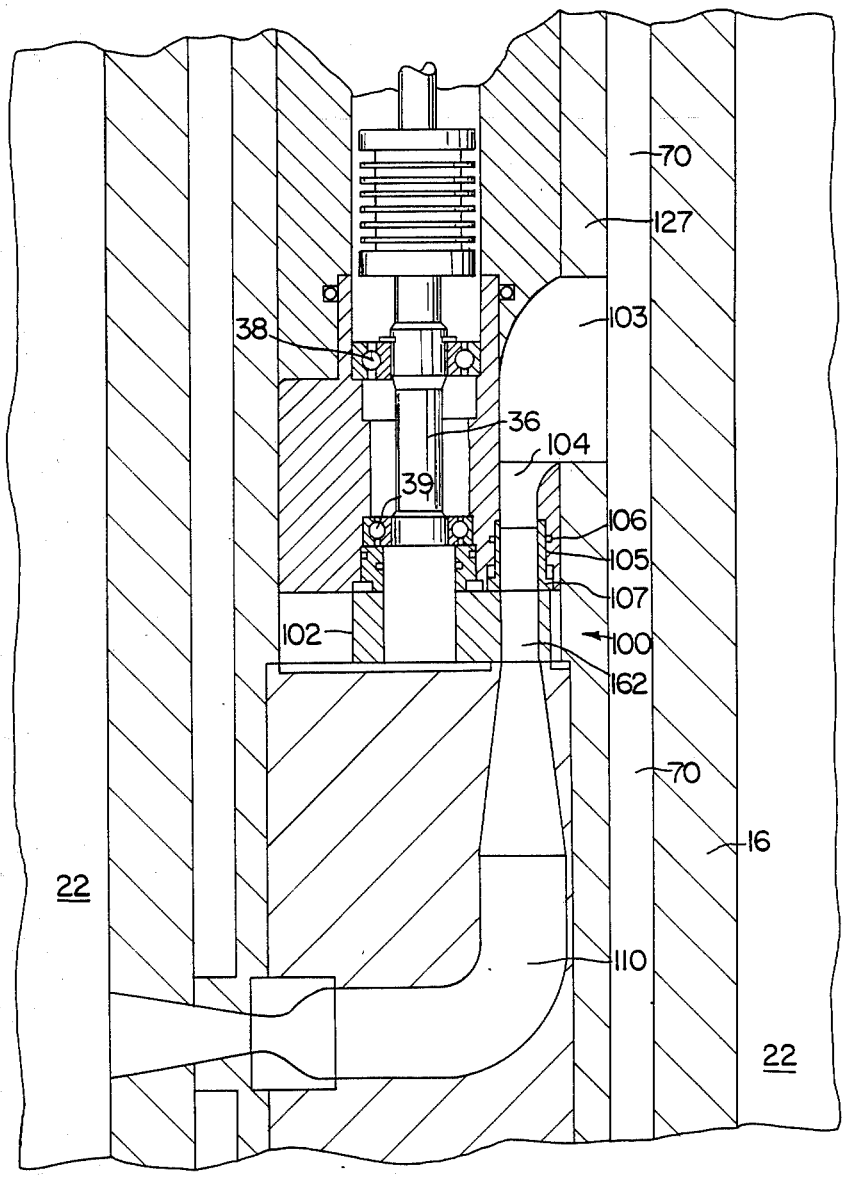
FIG. 5 is an enlarged, cross-sectional front elevational view of an alternate embodiment of the modulating valve of the present invention.

Referring now to FIG. 5, there is shown an alternative embodiment of a rotary acting shear valve 100 having a single flow port. The valve 100 produces a negative pressure pulse in the same manner as set forth above wherein a pair of solenoids (not shown) are positioned within housing 127 and attached to an actuation shaft 36 which is journaled in a pair of bearings 38 and 39. The lower end of the shaft 36 is attached to a gate member 102 having a single orifice 162. The housing 127 includes an upper recess 103 in flow communication with the central portion of the drill pipe and annulus 70. The recess 103 includes upper axial opening 104 in which is positioned a single cylindrical valve seat 105 sealed to the sides of the bore by a O-ring 106 and having a lower flanged portion 107 which is in flush engagement with the upper surface of the valve gate 102. The lower portion of the housing 127 includes exhaust flow passage 110 in flow communication with an exhaust port 112 which passes through the housing 127 and out through the walls of the sub 16 into the annulus 92 between the sub and the bore hole wall.

Still referring to FIG. 5, a rotary solenoid is actuated to rotate the shaft 36 and move the gate member 102 to either align or disalign the aperture 162 with the axial opening in the valve seat 105. This rotational actuation provides a mud flow passage from the central portion of the drill collar and annulus 70 to the annular space 72 and a negative pressure drop as set forth above. The single orifice gate member 102 will by definition require a larger orifice 162 to provide similar flow rates as the dual orifice configuration of FIG. 2. Likewise the shaft 36 must be mounted in such a manner as to compensate for the unbalanced loading produced by the single orifice.

Figure 6:
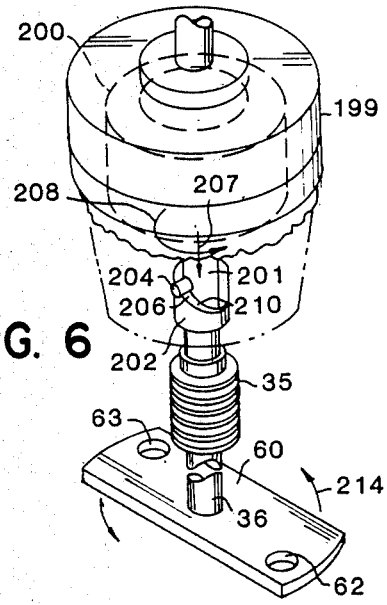
FIG. 6 is a diagramatic, illustration of one embodiment of a rotary solenoid drive system constructed in accordance with the principles of the invention.

Referring now to FIG. 6 there is shown a fragmentary, diagramatic, perspective view of one embodiment of a rotary solenoid drive system constructed in accordance with the principles of the invention. A rotary solenoid 199 is shown in phantom and comprises a power winding 200 and output shaft 201. The output shaft 201 is coupled to a ramp or cam 202 for converting axial movement of the shaft into rotational movement. The shaft 201 is thus constructed with a cam follower 204 disposed upon the ramp surface 206 for select translational movement. Axial movement of the shaft 201 imparted by the solenoid 199 in the direction of arrow 207 causes the cam follower 204 to slide downwardly upon ramp 206 imparting rotational motion in the direction of arrow 208. Rotation of the shaft 201 is carried through flexible coupling 35 and lower shaft 36 to valve gate 60. The valve apertures 62 and 63 are thus selectively oriented in accordance with the actuation of the solenoid 199. Maximum power in rotation of the valve gate 60 is affected by tailoring the curvature of ramp 206 as a function of the output force of the solenoid relative to the linear position of shaft 201. For example, the lower ramp section 210 is formed at the requisite slope to maximize rotational force output at a particular stroke position of the shaft 201. Moreover the ramp face 206 can be designed in a steeper configuration in the lower portion of the stroke to obtain a high torque output for a low axial force from the solenoid 199. As more force is obtainable from the solenoid 199, the ramp angle may be more shallow. Modification of the ramp angle thus permits tailoring of the force curve of the solenoid. Maximum torque is thus available across the entire rotation of the gate 60 in the direction of arrow 214 permitting the utilization of larger orifices 62 and 63. Large apertures produce greater flow rates and higher amplitudes in the negative pulse which is a distinct advantage over prior art methods and apparatus.

In the typical operation of the system described above, the tool string illustrated in FIG. 1 is provided with one or more instruments for detecting downhole parameters or the occurrence of downhole events. With any one of a number of detected events, the circuit components of the system provide a signal which, because of its encoded position in a format of signals, is indicative of the occurrence of or value of a specific event. Thus, this signal is sent in the form of an electrical pulse of sufficient time duration to actuate solenoid 28. This in turn will rotate gate 60 to align openings 62 and 63 in gate 60 with the flow openings in valve seats 46 and 47. The movement of the gate is rapid so that a rapid release of drilling fluid occurs through the aligned inlet and outlet openings 44 and 64, and 45 and 65 respectively. This sudden fluid flow through the valve openings permits drilling fluids under high pump pressures in the drill string 11 to be momentarily dischrged into borehole annulus 22. The discharge of high presure drilling fluids from the drill pipe 11 into the relatively low pressure annulus 22 causes a rapid pressure drop in the column of mud in the drill pipe 12 which is observable by transducer 25 in the mud standpipt 26 as a negative pulse. When the valve has opened for a sufficient duration to provide a pulse, solenoid 29 is actuated to move the unitary solenoid armatures toward the closed valve position as illustrated in FIG. 3B. Recordings of the pressure fluctuations observed at transducer 25 when format decoded by electronic package 25 (*a*), can provide a readout 25 (*b*) directly indicative of the downhole detected event or valve.

The foregoing of the invention has been directed in primary part to a particular preferred embodiment in accordance with the requirements of the patent statutes and for purposes of explanation and illustration. It will be apparent, however, to those skilled in the art that many modifications and changes in this specific apparatus may be made without departing from the scope and spirit of the invention. For example, the size, shape and materials as well as the details of the illustrated embodiment may vary. Therefore, the invention is not restricted to the particular form of construction illustrated and described, but covers all modifications which may fall within the scope of the following claims. It is applicants' intention in the following claims to cover such modifications and variations as fall within the true spirit and scope of the invention.

What is claimed is:

1. Valve apparatus useful in a borehole drilling fluid telemetry system for transmitting data pulses from one end of a pipe string to another by imparting pressure pulses to a drilling fluid circulating down the pipe string, through a drilling member and up the annulus between the pipe string and borehole wall, whereby the valve is operated in the drilling fluid flow path to modulate the flow of the drilling fluid and thereby impart detectable pressure pulses to the drilling fluid, comprising:

a housing disposable within said drill string, adapted for the flow of drilling fluid therearound and formed with a passage therethrough for selectable flow communication between said drill string and said borehole annulus;

a shear valve mounted within said housing across said passage and comprising a valve seat and rotational gate member having alignable seat and gate openings formed therethrough, said gate opening being movable in an arc into and out of axial alignment with said seat opening; and valve actuation means for coupling to said gate for rotationally moving said gate opening through an arc relative to said seat opening to open said passage and generate a pressure pulse, said valve actuation means comprising a first solenoid and cam means coupled thereto for translating the non-linear, axial forces of said solenoid into generally linear, rotational forces for rotating said valve gate.

2. The apparatus of claim 1 further including means for constantly urging said valve gate and said valve seat into contact.

3. The apparatus of claim 2 including means for constantly urging said valve gate against said valve seat.

4. The apparatus of claim 2 including means for constantly urging said valve seat against said valve gate.

5. The apparatus of claim 1 wherein said valve gate is a generally planar plate member having at least one gate opening therein, the edges of said gate opening being substantially protected from fluid flow through said valve in the open position.

6. The apparatus of claim 5 wherein the cross-section of said seat and gate openings in said valve seat and rotational gate are circular.

7. The apparatus as set forth in claim 1 wherein said cam means includes a ramp formed therein with a variable slope for translating non linear axial forces of said solenoid into a generally linear, rotational force for rotating said valve gate.

8. The apparatus of claim 7 wherein said valve actuation means includes a first solenoid having a drive shaft extending therefrom in connection with said valve gate for the rotation thereof, and cam means coupled to said shaft for translating linear actuation of said solenoid into rotational motion of said shaft.

9. The apparatus as set forth in claim 1 and further including a second solenoid coupled to said first solenoid and cam means for rotation of said valve gate in an opposite direction to that of said first solenoid.

10. The apparatus as set forth in claim 9 wherein said first and second solenoids are coupled one to the other and said first solenoid is secured to said housing.

11. The apparatus as set forth in claim 9 wherein said first solenoid is secured to said housing for imparting rotation relative thereto.

* * * * *